United States Patent [19]

Hunter

[11] 4,156,450

[45] May 29, 1979

[54] FOUNDRY MACHINE AND METHOD AND FOUNDRY MOULD MADE THEREBY

[75] Inventor: William A. Hunter, Schaumburg, Ill.

[73] Assignee: Heatherwill Company, Inverness-Palatine, Ill.

[21] Appl. No.: 815,574

[22] Filed: Jul. 14, 1977

[51] Int. Cl.[2] ..... B22C 9/20; B22C 11/04

[52] U.S. Cl. ..... 164/24; 164/181; 164/363; 164/365

[58] Field of Search ..... 164/24, 27, 29, 37, 164/40, 187, 213, 227, 323, 324, 363, 137, 181, 365; 249/126

[56] References Cited

U.S. PATENT DOCUMENTS

| | | | |
|---|---|---|---|
| 652,129 | 6/1900 | Michaelsen | 164/350 |
| 2,804,664 | 9/1957 | Brennan | 164/130 |
| 2,940,142 | 6/1960 | Wells et al. | 249/126 |
| 3,672,434 | 6/1972 | Grolla | 164/187 |
| 3,695,339 | 10/1972 | Taccone | 164/37 |
| 3,786,857 | 1/1974 | Sutherland | 164/129 |
| 3,817,314 | 6/1974 | Deve | 164/40 |
| 3,955,614 | 5/1976 | Geiger | 164/29 |

FOREIGN PATENT DOCUMENTS

| | | | |
|---|---|---|---|
| 3913364 | 7/1964 | Japan | 164/363 |

*Primary Examiner*—John McQuade
*Attorney, Agent, or Firm*—Richard C. Lindberg

[57] ABSTRACT

A machine for forming foundry moulds includes a turret supporting spaced mould frames, each of the latter having a mould portion formed therein by rotation of the turret toward a sand filling and compacting station and away therefrom. The completed mould portion may be moved to a position where a core can be set thereon and then moved to a position where the mould portions are positioned one atop another to make a stack of finished and cored moulds. When the moulds are not cored, a pair of said filling and compacting stations are provided, the turret oscillating or rotating unidirectionally from a loading position to a delivery position. Where a pair of filling and compacting stations are provided for forming cope and drag mould portions, the turret oscillates to place the two mould portions in proper position to form a mould comprised of cope and drag portions. The machine makes foundry moulds capable of being placed one atop another, a pair of moulds defining a pouring lip connected to a pouring channel in turn connected to runners and mould cavities.

16 Claims, 16 Drawing Figures

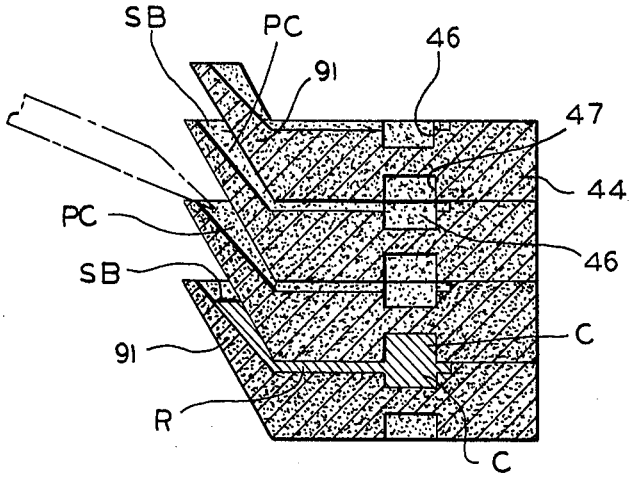
FIG. 8
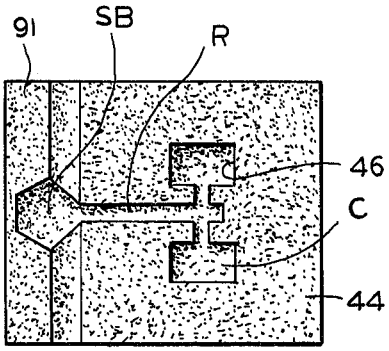
FIG. 9
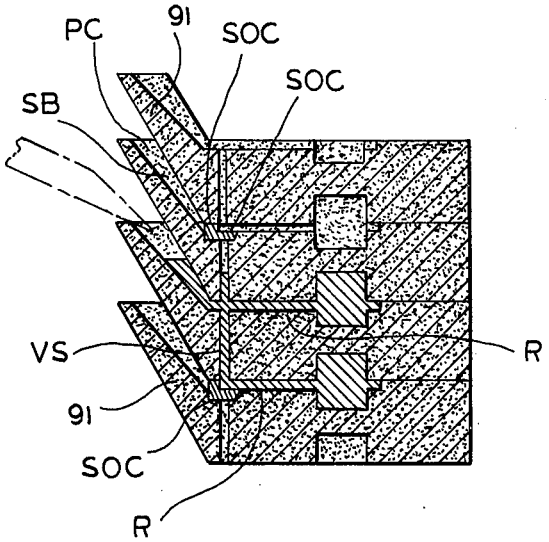
FIG. 13
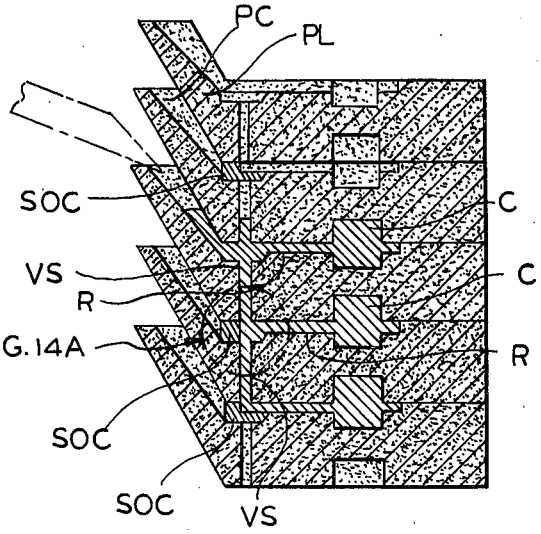
FIG. 14
FIG. 15
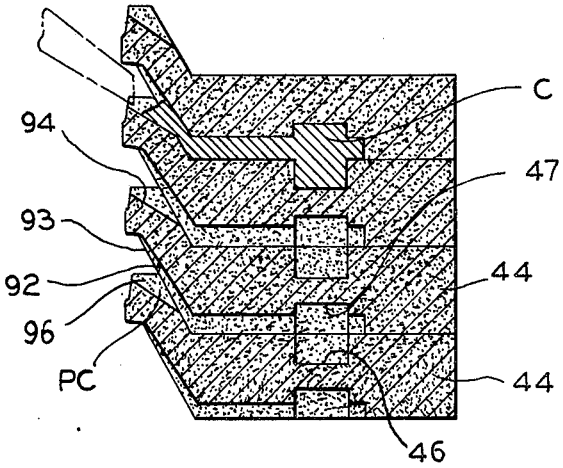
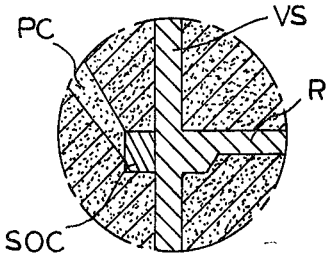
FIG. 14A

FOUNDRY MACHINE AND METHOD AND FOUNDRY MOULD MADE THEREBY

BACKGROUND AND SUMMARY OF THE INVENTION

The present invention relates generally to machinery for the automatic making of moulds for the casting of metals or the like. The structures as disclosed in this application provide both an improvement over the art as shown in Hunter U.S. Pat. No. 3,406,738 for Automatic Matchplate Moulding Machine, and in addition thereto apparatus adapted both to cope and drag moulding and stack moulding both with and without core setting.

In all embodiments of the invention mould portions are formed in mould frames mounted on a turret which goes through angular displacements to place the mould portions one atop another to form a finished slip mould ready for the pouring operation, the poured moulds being removed from the machine after a suitable cooling interval.

In one embodiment of the invention the mould portions are formed on their upper and lower surfaces with half cavities, so that when the mould portions are stacked one atop another two mould portions define a complete cavity. In the forming of such slip moulds the turret moves a mould frame to a loading position where it is filled and squeezed to form a mould portion, subsequently moved with its frame to a second position where cores may be set in the upper half cavity, then moving the cored mould portion to a final position where the mould portion is delivered for the subsequent placement thereon of a like mould portion. Ultimately a stack of such finished moulds complete with cores is then ready for pouring. Moulds may be poured singly, or in multiples by the use of stop-off cores and interconnecting sprues.

By adapting the invention structure the step of core setting is dispensed with, and the turret for the mould frame cooperates with a pair of sand loading devices, each forming a mould portion thereat, the turret oscillating back and forth to deposit mould portions one atop another at delivery positions each disposed between the two sand loading devices.

The invention structure may also be modified so that a cope mould is formed at one sand filling and compaction station with a half pattern, forming a cavity in the lower surface of the cope mould, and a drag mould at the other sand filling and compacting station with a mating half pattern forming a cavity in the upper surface of the drag mould. The turret oscillates to deposit a cope mould on a drag mould at delivery positions, each disposed between the sand filling and compacting stations.

Where the machine is adapted for use in stack moulding without core setting or for use in cope and drag moulding, the production rate can be anticipated to be twice that with stack moulding and core setting.

Moreover, the apparatus lends itself to a multiplicity of sand filling and compacting stations for situations where core setting may be employed or not employed, or for cope and drag moulding both with and without cores.

The invention also comprehends the formation of unique moulds which are disposed one atop another, two moulds defining a pouring channel connected to a runner and mould cavity. Such runners may be connected by vertical sprues and when employed with stop off cores, one pouring channel only may be employed for pouring a number of castings at one time from a single pouring channel.

THE DRAWINGS

FIG. 8 is a sectional view through a stack of completed moulds adapted to be held in position in the structure seen in FIG. 5, showing the lower moulds of the stack being poured;

FIG. 9 is a plan view showing a mould portion fashioned by the invention structure and forming part of the stack seen in FIG. 8;

FIG. 13 is a view similar to FIG. 8 showing how the mould portions may be provided with vertical sprues and stopoff cores to enable a plurality of gatings of castings to be poured from a single point, in this case two gatings being poured at one time;

FIG. 14 is a view similar to FIG. 13 showing the manner in which three gatings are poured at one time;

FIG. 14A is an enlarged scale detail view of FIG. 14 showing details of a particular form of stop off core for preventing flow of founding material into a sprue basin disposed below the point of pouring; and FIG. 15 is a view similar to FIGS. 8, 9, 13 and 14 showing further details of the mould portions.

SPECIFICATION

Figure 1:
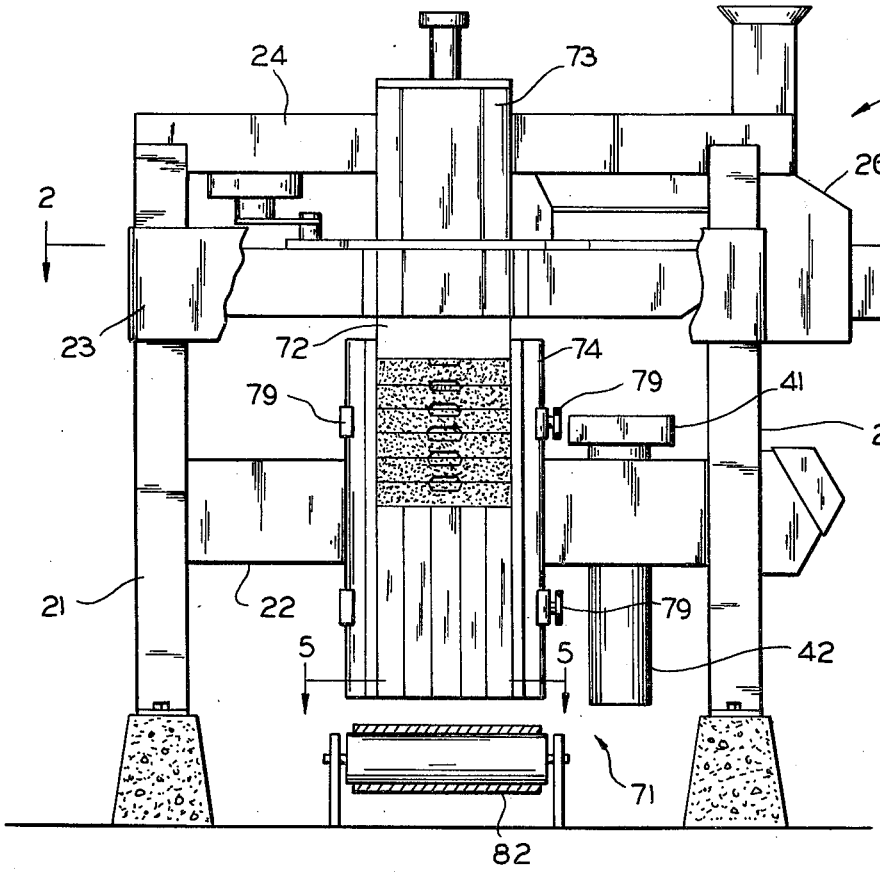
FIG. 1 is an elevational view of a foundry machine embodying the improvements according to the present invention.

The foundry machine according to the present invention is referred to by the reference numeral 20 and comprises vertical frame members 21 which are spanned by horizontal frame members 22, 23 and 24. A moulding sand supply device referred to generally by reference numeral 26 is arranged to supply moulding sand to a mould frame 27 having spaced walls 30 mounted on a turret 28 which rotates through a predetermined angle in step-by-step fashion.

The turret 28 supports four equiangularly spaced mould frames 27, and has a center post 29 with paired arms 31 extending substantially radially therefrom. The ends of each pair of arms 31 have vertically extending guide rails 32 for vertical movement of the mould frames 27 with respect to the center post 29. Each of the mould frames 27 is provided with rollers 33 embracing the guide rails 32 for such movement. Each mould frame 27 has a vertical leg 34 extending downward from the back thereof with a foot 36 extending therefrom guided along a lower vertical rail 37 secured to centerpost 29. A stop member 38 secured to leg 34 has a bumper 39 along the lower side thereof arranged to contact the upper end of vertical rail 37 to limit downward movement of a mould frame 27.

Mould frame 27 is arranged to be filled with moulding sand from the supply 26, the open bottom of frame 27 being closed by a platen 41 having a lower half pattern LHP thereon. Pattern LHP is continuous with a runner pattern RP and a sprue pattern SP. The platen 41 is raised by a cylinder 42 to close the bottom of mould frame 27 and continuing upwards taking with it the mould frame 27.

Continuing movement upward of platen 41 with mould frame 27 takes place until frame 27 encounters an upper fixed platen 43 having an upper half pattern UHP and runner R affixed to the underside thereof.

A chamber 25 is thus formed within mould frame 27, upper platen 43 and lower platen 41 for the reception of a measured quantity of moulding material from the sand supply device 26. Continued extension of the cylinder 42 squeezes the moulding sand within chamber 25 to define a slip mould portion 44 having an upper half cavity 46 and a lower half cavity 47 as seen in FIG. 8. When the mould portions 44 are stacked as seen in FIG. 8, the upper and lower cavities are in register and are connected by runners R to a sprue basin SB to form a casting gating C when poured. The term "gating" herein means a complete casting formed by sprues, runners, gates and casting cavities.

The platen 41 retracts after the squeeze of the sand within the mould frame 27 and the compacted sand mould portion 44 within mould frame 27 is held frictionally to the interior walls thereof. Frame 27 moves downward along its guide rails 32 and 37 during such retraction. The frame 27 is thus withdrawn from the upper platen 43 and the downward motion of frame 27 is stopped when bumper 39 contacts rail 37. Further downward motion of platen 41 and lower half pattern LHP draws pattern LHP from mould portion 44 and frame 27 leaving both in position for rotation as will be described.

Thereafter the turret moves through a 90° angle with the mould frame 27 to a position where one or more cores (not shown) may be placed in position on the mould portion 44.

Structure is provided for moving turret 28 through a succession of angular displacements whereby succeeding mould portions 44 may be formed in a succeeding mould frame 27 at the sand supply apparatus 26. To this end the turret has a circular Geneva-type turret plate 52 at the upper end thereof fast to the shaft 29 of turret 28. The lower end of center post 29 is mounted in a bearing 51 supported on the lower frame 22. The Geneve-type turret plate 52 is provided with sets of spaced lands 53 and 54, see also FIG. 7, each pair of lands 53 and 54 being arranged in 90° spaced apart relationship to a like pair on the top of the plate 52.

Structure is provided for turning the plate through successive 90° angular displacements, and each pair of spaced lands 53 and 54 cooperate with a Geneva arm 56 having a roller 58 at the end thereof engaged between the spaced lands 53 and 54. The arms are part of a spider 59 mounted fast to a shaft 61 driven by an intermittently operated gear drive motor 62.

Figure 7:
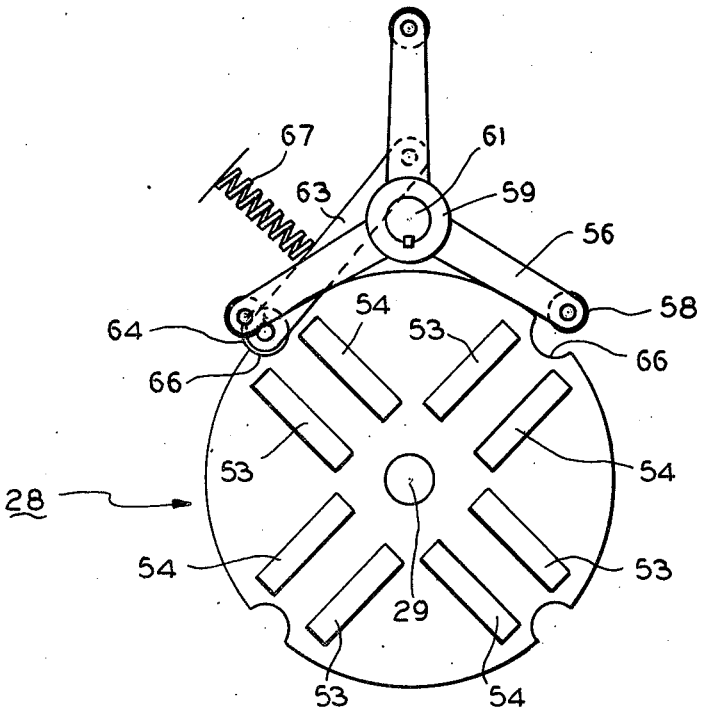
FIG. 7 is a schematic plan view of a Geneva-like structure for giving rotary movement to the mould frames seen in FIGS. 2 and 6.

As shown particularly in FIG. 7 for each 120° displacement of arm 56 the Geneva table 52 moves through a 90° displacement. The table 52 is locked in position by means of a detent arm 63 having a roller 64 at the end thereof engageable with a notch 66 in the periphery of the table 52. The arm 63 and its roller 64 are biased against the periphery of the table 52 by a spring 67.

Figure 2:
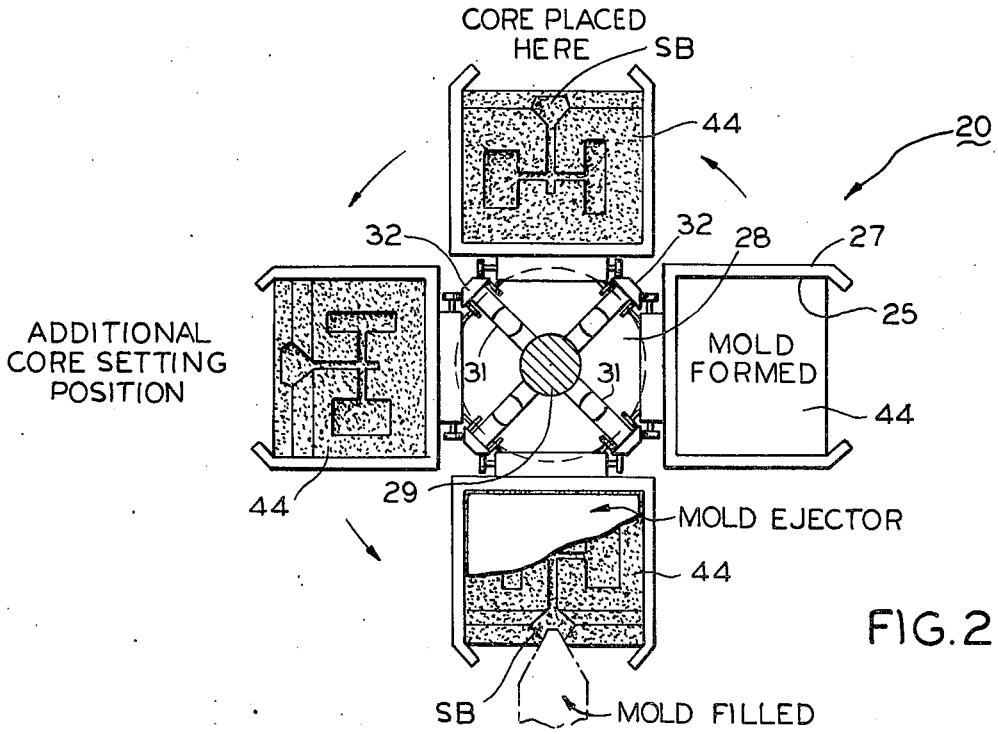
FIG. 2 is a schematic plan view thereof.
Figure 3:
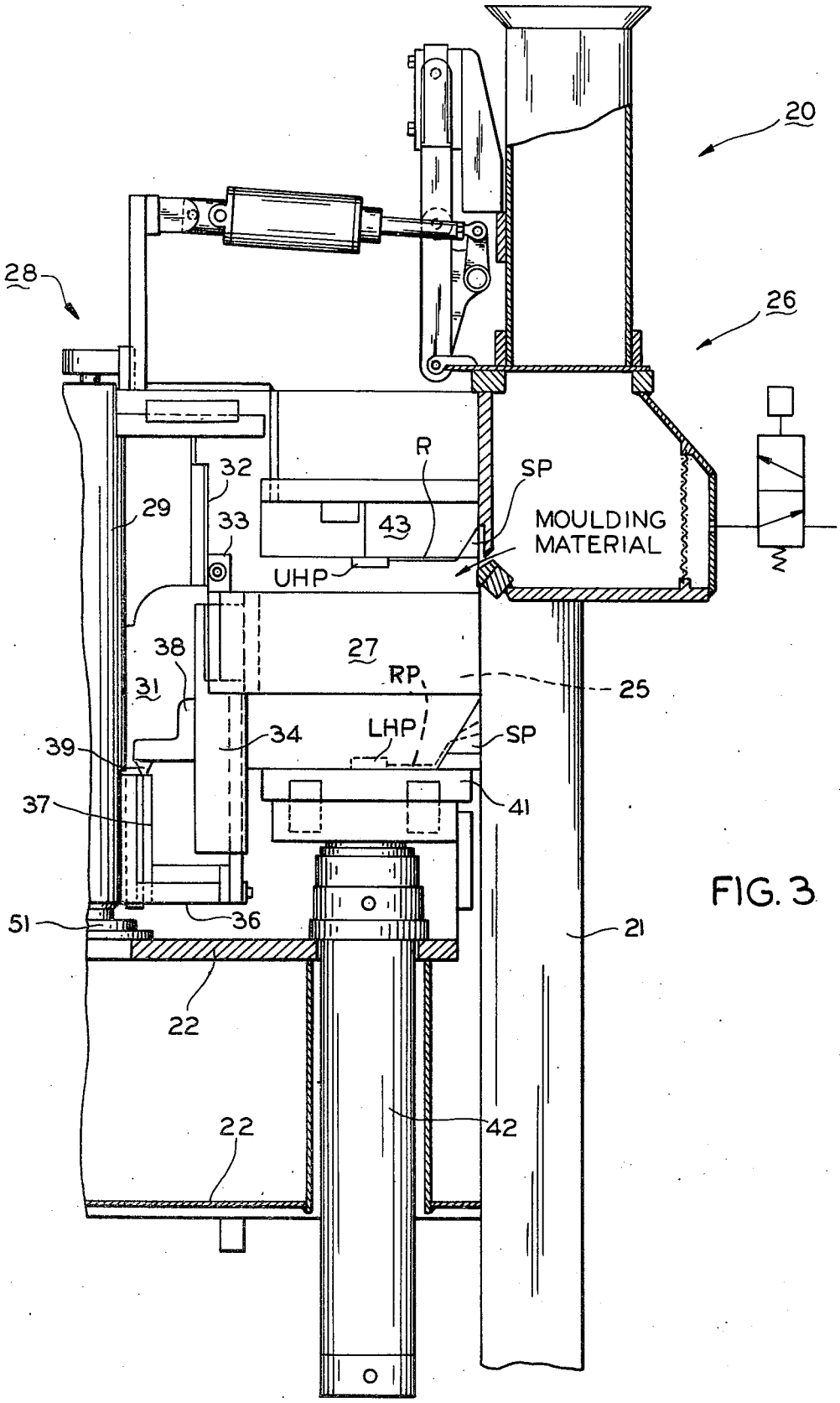
FIG. 3 is a detailed elevation view, parts being shown in section, of that portion of the machine where moulding sand is supplied to a mould frame and a mould portion is formed.

As seen in FIG. 2, after the formation of the mould portion 44 within the mould frame 27 it is moved through successive angular displacements where core setting may be accomplished, and then to a structure 71 where the mould portions 44 are expressed from the mould frame 27. Such structure includes a moveable platen 72 having an area and configuration like the upper surface of the mould portion 44, platen 72 being moved in vertical directions by a cylinder 73 secured to the upper frame 24.

Figure 4:
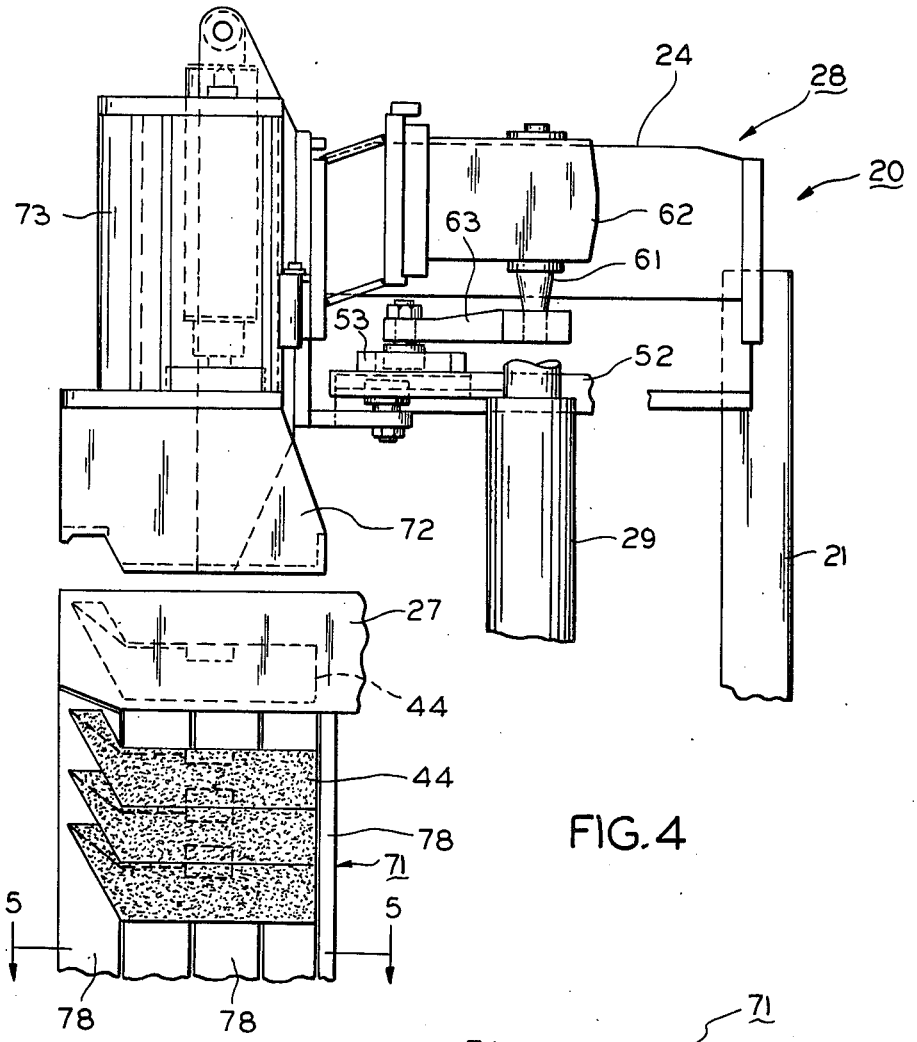
FIG. 4 is a fragmentary elevation view of that portion of the machine where finished moulds are delivered.
Figure 5:
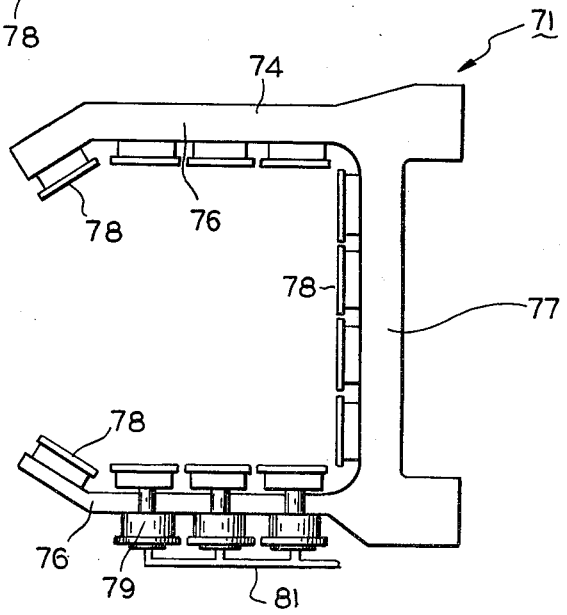
FIG. 5 is a detailed plan view of structure for holding stacked moulds in position for pouring, cooling and delivery, said figure looking in the direction of the arrows 5—5 of FIGS. 1 and 4.
Figure 6:
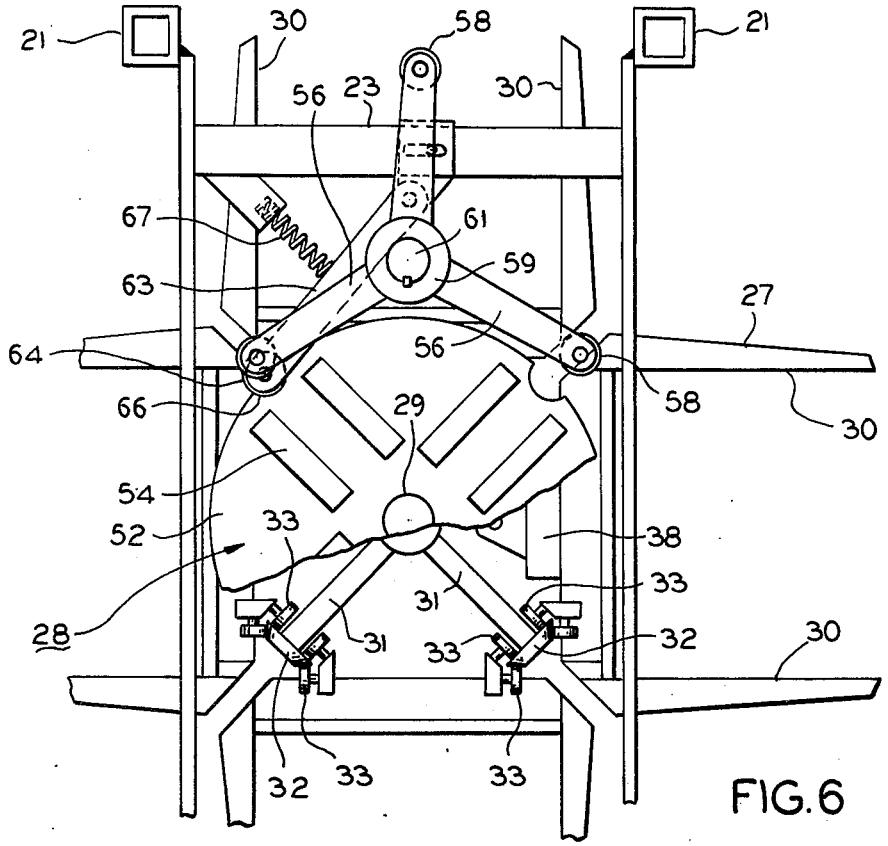
FIG. 6 is a schematic plan view of a turret for supporting the mould frames, and for causing the mould frames to move through rotary displacements.

The structure 71 for expressing the mould portion 44 includes a U-shaped frame 74 corresponding in plan to the plan of the mould frame 27 and the mould portion 44 formed therein. Frame 74 has spaced walls 76 extending from a vertical backwall 77. Each of the walls 76 extends downward for a distance to confine a stack of mould portions 44 therebetween frictionally as seen in FIGS. 1 and 4 particularly, and the walls 76 and the back wall 77 are lined with vertical pressure members 78 which exert pressure against the sides of the mould portion 44, such pressure being maintained by air cylinders 79 supplied by a common line 81 and creating sufficient friction to hold the mould portions 44 in position except when downward pressure is exerted by platen 72.

Figure 10:
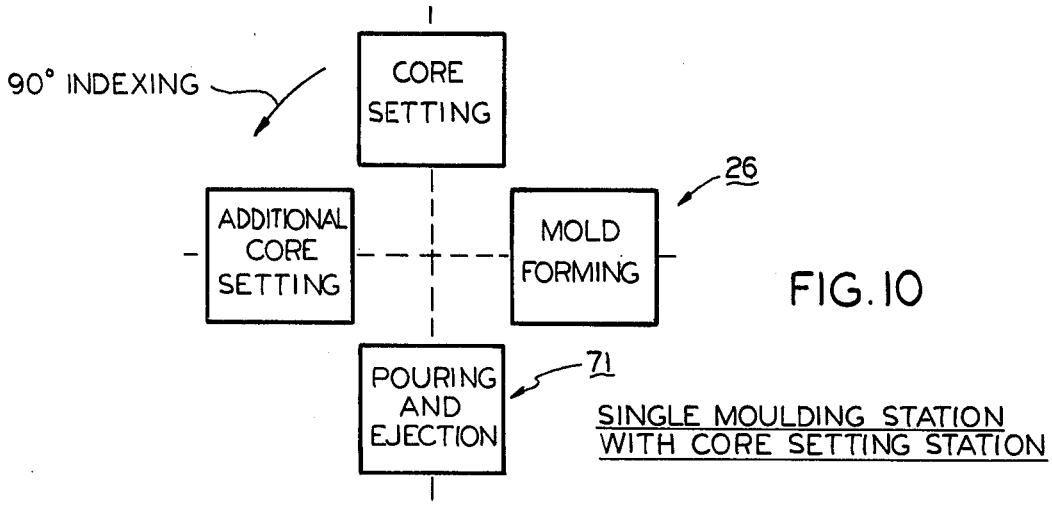
FIG. 10 is a diagram showing the steps taking place in the machine of FIGS. 1 to 9.

The sequence of operations described thus far is shown in the diagram of FIG. 10 which shows mould frame filling and mould portion forming taking place, and subsequent core setting at subsequent positions of mould frame 27 and mould portion 44, and final pouring and ejection of the poured moulds. At the conclusion of such pouring and after cooling of the castings has been accomplished further movement of the platen 72 in its expressing operation will move completed and cooled moulds to a conveyor 82 seen in FIG. 1.

Figure 11:
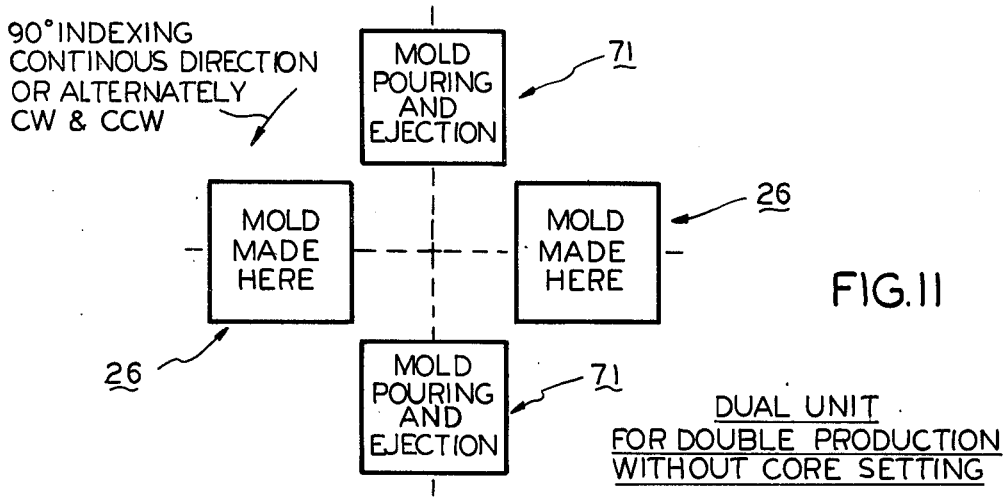
FIG. 11 is a diagram showing the steps taking place in the machine as adapted for use without core setting.

Referring now to FIG. 11, there is shown an adapted form of the invention where the machine can achieve a double rate of production when core setting is not performed on the mould portion. In this arrangement there are two sand filling devices spaced 180° apart, turret 28 moving through 90° of displacement to mould pouring and ejection structures placed between the sand supply devices.

In this embodiment of the invention the turret 28 may instead be oscillated through 90° for such purpose, if desired.

Figure 12:
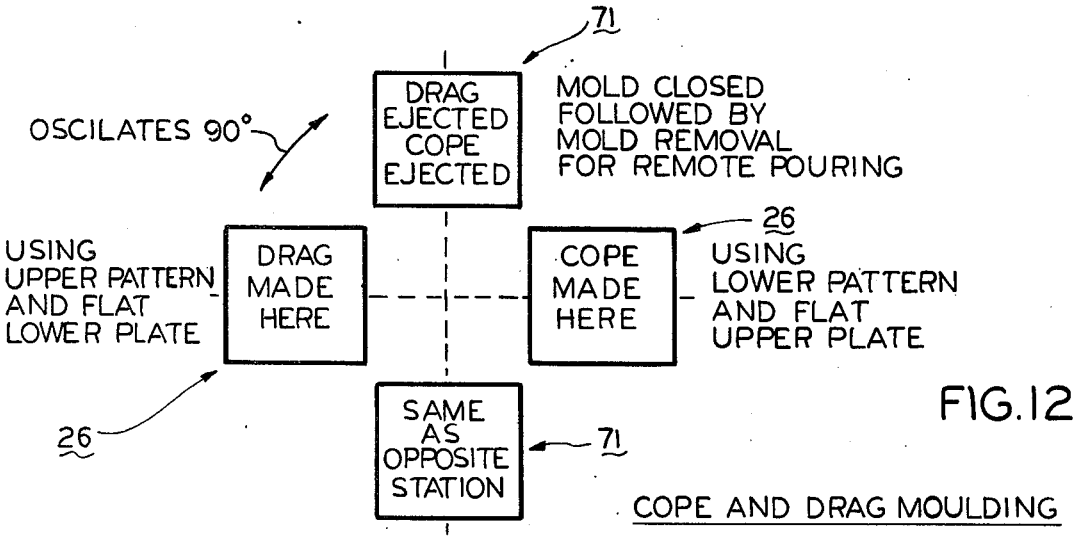
FIG. 12 is a diagram showing the steps taking place in the machine as adapted for use in cope and drag moulding.

Referring now to FIG. 12 there is shown still another adaptation of the invention structure described wherein the turret oscillates back and forth through 90° of angular displacement. At one of the mould filling stations described a cope mould can be made and at the other a drag mould. Turret 28 then rotates in a direction to place a drag mould portion within the ejection and pouring structure 71, and thereafter a cope mould is rotated by the turret through an opposite 90° angular displacement to place the cope mould portion upon the drag mould portion already transferred to structure 71.

The other ejecting structure 71 also receives cope and drag mould portions in like manner to those supplied to the first described ejecting structure 71.

It may be noted that the sand supply structure is shown in very general terms only, and structures for supplying sand to the mould frame can be of any commercially available kind.

It should be understood that the functions described are under control of electrical and fluid circuitry, not disclosed, and such circuitry forms no part of the present invention.

Reference is now made to FIGS. 8, 9, 13, 14, 14A and 15 wherein there is shown the mould portions 44 arranged in a stack thereof as seen in FIG. 4. As seen in FIGS. 8 and 9, each mould portion 44 has an upper cavity 46 and a lower cavity 47, these being in register to form a casting C or a gating of castings therein when poured.

Each mould portion 44 has an extension 91 each defining with a subjacent portion 44 a pouring channel PC and a sprue basin SB. The lower side of extension 91 of a superjacent portion 44 and the upper side of extension 91 of a subjacent portion 44 define a converging channel leading to a runner R in turn connected to mould cavities 47 and 46.

As seen in FIG. 15 particularly, the underside 92 of extension 91 of a superjacent portion 44 is flanked by spaced sides 93, while the upper side 94 of subjacent portion 44 is flanked by spaced sides 96 which register with spaced sides 93 of superjacent extension 91, the aforesaid sides defining the sprue basin SB connected to runner R.

The mould portions 44 may be arranged in such a fashion that pouring may be carried on at a pair of extensions 91, the founding material coursing into a number of cavities to provide a number of gatings C at one pouring. As seen in FIGS. 13 and 14, the runners R are connected by vertical sprues VS. Such sprue VS above the poured point are blocked by a stop off core SOC seen in FIG. 13 at the intersection of the lower pouring channel PC, and the sprue VS between pouring channel PC and runner R above the pouring point being blocked by a like stop off core SOC.

As seen in FIGS. 14 and 14A, the arrangement is such as to pour three gatings C from one pouring point. In FIG. 14A there is shown a special form of stop off core SOC for blocking a pouring channel PC below the channel where pouring takes place and above the lowermost cavities C of a stack being poured.

I claim:

1. A method of forming foundry moulds which comprises the steps of:

(a) mounting a plurality of moulding frames in spaced relationship upon a turret;

(b) forming a mould portion in a moulding frame;

(c) rotating said turret and said mould frame with a mould portion held in said mould frame to a position for expressing the mould portion from said mould frame;

(d) expressing the mould portion from said mould frame;

(e) forming successive mould portions in successive moulding frames as said turret moves in step by step fashion and expressing said mould portions in positions one atop a previously expressed mould portion to provide a stack of moulds for pouring.

2. A foundry machine for forming moulds comprising:

(a) a support frame and a turret supported therein having means supporting at least one moulding frame;

(b) means for placing a quantity of mould forming material into a mould frame;

(c) cavity forming means cooperating with said moulding frame and the mould forming material therein to define a mould portion having at least one cavity therein;

(d) means for rotating said turret through a predetermined angle with said mould portion supported by said moulding frame;

(e) means disposed on said support frame for expressing said mould portion from said moulding frame;

(f) means disposed in the path of rotative movement of said turret and said moulding frame for receiving the mould portion from said moulding frame and disposed in position to receive another mould portion superimposed thereon.

3. The foundry machine according to claim 2 wherein said expressing means is operable selectively to express poured moulds from said receiving means.

4. The foundry machine according to claim 2 wherein a cavity is formed on the upper side of said mould portion.

5. The foundry machine according to claim 2 wherein a cavity is formed on both the upper and lower sides of said mould portion.

6. The foundry machine according to claim 2 wherein said turret is adapted to move through an angular displacement to a position for placement thereat of a core in the cavity of said mould portion.

7. The foundry machine according to claim 6 wherein said turret is adapted to move with said cored mould portion to a subsequent angular position where said cored mould portion is expressed from the moulding frame.

8. The foundry machine according to claim 2 wherein said turret supports a plurality of angularly spaced moulding frames.

9. The foundry machine according to claim 2 wherein said turret supports a plurality of angularly spaced moulding frames, and said means for placing a quantity of mould forming material are disposed between said means for expressing a mould portion and said turret rotates in steps to form a mould portion and to place previously formed mould portions into an expressing means.

10. The foundry machine according to claim 9 wherein said turret moves in an oscillating manner.

11. The foundry machine according to claim 9 wherein one of said placing means cooperates with first cavity forming means to form a cope mould portion with a mould cavity portion on the underside thereof, and another of said placing means cooperates with second cavity forming means to form a drag mould portion with a mould cavity portion on the upper side thereof.

12. A foundry mould portion particularly adapted to be arranged in stacked relationship with at least one or more foundry mould portions for pouring of a gating between each of said mould portions, said mould portion comprising:

(a) a mould portion body having a mould cavity in at least one of the upper and lower surfaces thereof for forming a gating when a like mould portion body is superimposed on said first named mould portion;

(b) a pouring lip formed mould portion body and defining with the pouring lip of another mould portion body a pouring channel for founding material arranged to flow to said cavity;

(c) said pouring lip being defined by an upward extension from said mould portion body and upper and lower surfaces on said pouring lip partially defining adjacent pouring channels.

13. A foundry mould portion according to claim 12 wherein the upper surface of one mould portion body and the lower surface of an adjacent lower mould portion body form a runner connected to said cavity.

14. A foundry mould portion according to claim 12 wherein the upper and lower surfaces of the pouring lip define with like foundry mould portions sprue basins for founding material.

15. A foundry mould portion according to claim 12 wherein said cavity is connected to a pouring channel by a runner and wherein each mould portion contains a vertical sprue adapted to connect the runners of superimposed mould portions whereby a number of mould portions may be poured simultaneously from one pouring channel.

16. A foundary mould portion according to claim 15 including stop off cores adapted to be placed at the junctures of certain pouring channels and certain of said runners to regulate the flow of founding material.

* * * * *

UNITED STATES PATENT AND TRADEMARK OFFICE

CERTIFICATE OF CORRECTION

PATENT NO. : 4,156,450

DATED : May 29, 1979

INVENTOR(S) : William A. Hunter

It is certified that error appears in the above-identified patent and that said Letters Patent are hereby corrected as shown below:

Claim 12, par. (b) after "formed" insert -- on the --.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*